United States Patent [19]

Ganter

[11] Patent Number: 4,548,514

[45] Date of Patent: Oct. 22, 1985

[54] WRISTWATCH HAVING TUBULAR SEAL AND METHOD FOR ASSEMBLY

[75] Inventor: Wolfgang Ganter, Schramberg, Fed. Rep. of Germany

[73] Assignee: Gebruder Junghans GmbH, Schramberg, Fed. Rep. of Germany

[21] Appl. No.: 584,339

[22] Filed: Feb. 28, 1984

[30] Foreign Application Priority Data

Mar. 5, 1983 [DE] Fed. Rep. of Germany ... 8306359[U]

[51] Int. Cl.[4] ..... G04B 37/00

[52] U.S. Cl. ..... 368/291; 368/289; 368/308; 368/309

[58] Field of Search ..... 368/287, 289, 291, 292, 368/294–296, 309

[56] References Cited

U.S. PATENT DOCUMENTS

| | | | |
|---|---|---|---|
| 2,831,315 | 4/1958 | Piquerez | 368/291 |
| 2,875,574 | 3/1959 | Dinstman | 368/291 |
| 3,479,771 | 11/1969 | Steimann | 368/291 |
| 3,492,810 | 2/1970 | Levrat | 368/287 |
| 3,828,549 | 8/1974 | Nozawa | 368/294 |

FOREIGN PATENT DOCUMENTS

| | | | |
|---|---|---|---|
| 6649 | 6/1979 | European Pat. Off. . | |
| 348928 | 10/1960 | Switzerland | 368/289 |
| 376436 | 12/1963 | Switzerland | 368/295 |

*Primary Examiner*—Bernard Roskoski

*Attorney, Agent, or Firm*—Burns, Doane, Swecker & Mathis

[57] ABSTRACT

A wristwatch includes an assembly comprising a hard plastic seal in the form of a hollow tube in which are mounted a crystal, a movement and face, and a bottom cover. That assembly is inserted as a unit into the bottom end of an opening of a clamping ring. A portion of the opening overlies a portion of the tube to limit the extent of upward movement of the tube in the opening. The opening of the clamping ring includes an inwardly facing groove into which a portion of the tube may project to axially secure the tube. A setting shaft projects through the clamping ring and tube and is surrounded by an O-ring mounted in a recess of the tube. The clamping ring comprises a case and a bezel mounted thereon. Different bezels can be employed to change the appearance of the wristwatch.

8 Claims, 2 Drawing Figures

WRISTWATCH HAVING TUBULAR SEAL AND METHOD FOR ASSEMBLY

BACKGROUND AND OBJECTS OF THE INVENTION

Figure 1:
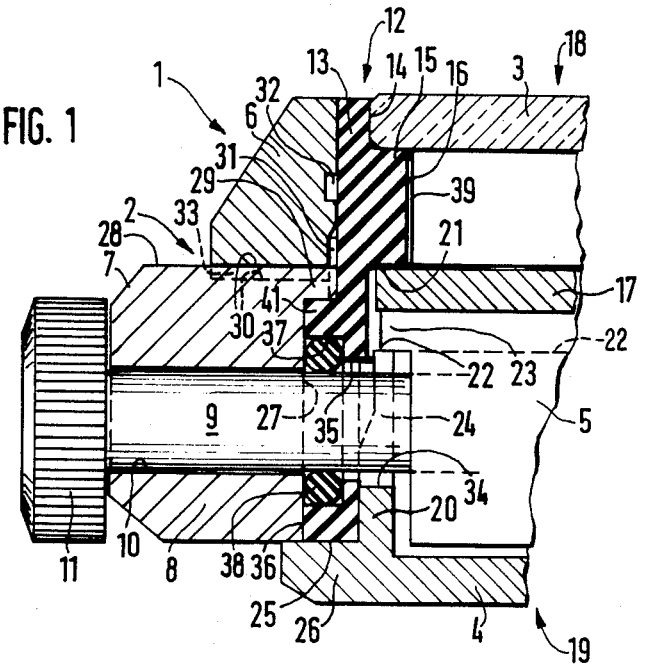

The invention relates to a wristwatch. In particular, the invention concerns a wristwatch of the type wherein a crystal is disposed within a hollow cylindrical seal, and the seal is disposed within a case. A bottom cover is inserted into the bottom of the seal.

A wristwatch with this configuration is known from EP-OS No. 6 649. For the use of metal cases that may be produced inexpensively, it is disclosed therein to only roughly shape the inner profile of the annular case which extends as a single piece essentially along the axial height of the wristwatch and then to vulcanize-in a seal comprising a layer of a rubber elastic synthetic material which conforms to the contour or profile of the metal. The elastic material serves, on the one hand, to compensate radially and axially for the dimensional tolerances of the roughly-shaped metal case and, on the other hand, to receive in a tight, frictional manner a crystal and a bottom cover. A disadvantage herein is that if a hard elastic material is employed as the seal, the radial support provided by the case is rigid to the extent that during the axial installation of the crystal, a phenomena can occur which is detrimental to sealing and the appearance of the watch, such as material displacement or even spalling. If a soft elastic material is employed as the seal, there may not occur a sufficient stability and reliable sealing.

In view of these conditions, it is an object of the invention to provide a wristwatch of the afore-mentioned type, and method for assembling same, which satisfies the requirements of simple assembly and high seal reliability and, in addition, opens up new possibilities in regard to forming multiple models of different appearance with low production costs.

SUMMARY OF THE INVENTION

This object is attained in a wristwatch of the aforementioned type which comprises a clamping ring having an opening therethrough, and an assembly insertable as a unit into the opening. The assembly comprises a hollow cylindrical seal in the form of a hard plastic tube having a radial inward projection on an inner wall thereof to form a seat at an upper end of the tube. A crystal is mounted in the seat by press-fit. A movement and face are mounted within the tube. A bottom cover is mounted in a bottom end of the tube.

The present invention also includes a method of assembling components of a wristwatch. The method comprises the steps of providing a seal in the form of a hollow cylindrical tube made from a hard plastic material. A crystal is inserted into an upper end of the tube such that the crystal is frictionally held against an inner wall of the tube and sits upon a stop shoulder of the tube. A movement and face are inserted into a bottom end of the tube. A bottom cover is inserted into a bottom end of the tube to secure the movement and face within the tube. The assembled tube, crystal, movement, face and cover are inserted as a unit into an opening of a case such that the case functions to radially reinforce the tube.

As a result, the insertion of the functionally essential parts of the wristwatch into a separately produced and separately handled tubular seal (of a hard elastic material) is made possible. The tubular seal is capable of an elastic widening in the radial direction during the assembly of components thereinto. Thus, the tube can receive the crystal without impairing the material conditions or the geometrical design. Following the insertion of the movement and bottom cover into the tube, a unit is formed that is conditionally operational and may thus be tested. Only then is a clamping ring applied in the form and function of the watch case center, i.e., is designed as a case for the attachment of the wristband and the guidance of the setting shaft. Without the need for additional sealing, this case center may be in two parts, i.e., the case itself and a further clamping ring placed around the area of the crystal, the further clamping ring being in the form of a crystal bezel. The bezel can be made available in different configurations depending on the particular model. This further renders a flat dimensioning of the case possible, so that it may be stamped in an extremely cost effective manner from a flat, semi-finished material and subjected to final processing on its planar, parallel top and bottom surfaces and in a pack form. Compared to the processing of such flat, stamped blanks edge in a plane parallel manner, a die stamped blank, upon which the production of a case according to the aforecited EP-OS No. 6 649 must be based, would cost approximately six to seven times as much under identical conditions, in view of the higher number of production and processing steps required by the thickness of the material. The configuration according to the present invention, on the other hand, favors the production of less expensive and still flatter, thus smaller wristwatches of a more pleasing appearance.

The raised rim of the tube is provided in the form of a rib-shaped projection toward the inside tube. In the interest of defined assembly conditions, primarily with respect to the mutual axial coordination, it is also appropriate to terminate or taper the location hole in the upper area of the case and correspondingly to project the sealing tube in its lower area in the outward direction. Conveniently, in this latter area of greater wall thickness of the sealing tube a radial or transverse bore is provided for the passage of the setting shaft through the wall of the sealing tube. An enlargement of this bore outwardly by means of a recess into which an O-ring is inserted, relocates the complete sealing of the setting shaft into the sealing tube. The setting shaft bore in the clamping ring of the case thus has only a guiding function. The need for the installation of a setting shaft sleeve into the case and the conventional configuration of the setting shaft crown to receive a gasket, are thereby eliminated. This, in turn, makes it possible to develop a crown smaller both in the radial and the axial direction, of a more pleasing appearance, which no longer needs to exceed appreciably the cross-section of the setting shaft.

THE DRAWING

Figure 2:
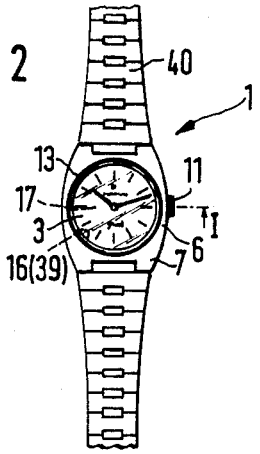

Further developments and alternatives, together with additional characteristics and advantages of the invention will become apparent from the description of a preferred embodiment shown in the drawing approximately at scale and with restriction to the essential, and in which:

FIG. 1 shows a configuration of a wristwatch according to the invention in a cross-section through the setting shaft in a greatly enlarged and broken view, and FIG. 2 is a view of a wristwatch according to FIG. 1 in its natural size.

BRIEF DESCRIPTION OF A PREFERRED EMBODIMENT OF THE INVENTION

The wristwatch sketched in a cross-section in FIG. 1 comprises essentially a two-part case center 2. A watch movement 5 is mounted in a water-tight manner between a crystal 3 and a bottom cover 4 of the watch. The case center comprises a bezel 6 and the case 7 proper. A setting shaft 9 penetrates through the wall 8 of the latter and carries a crown 11 in front of the setting shaft bore 10. The opposite end of the setting shaft 9 protrudes into the movement 5.

To seal-off the inside of the wristwatch 1, a one-piece seal 12 is provided in the form of an axially short tube 13 extending axially the height of the case center 2 and coaxially with the case center 2. The seal constitutes an injection-molded part formed of a hard plastic material which exhibits little cold flow and has good creep strength even over a wide temperature range. The seal can be formed with a high dimensional accuracy by the injection molding process and afterwards retains a certain plasticity. A suitable material based on polyester elastomers is commercially available under the tradename "Hytrel R", but polyamides and acetal resins may also be utilized.

The inner wall 14 of the tube is essentially cylindrical. In the upper half of the axial extent of the tube 13 there is, however, an annular projection 15 facing the inside of the tube. This projection serves as a raised rim 16 between the crysal and the face 17 of the watch fastened to the movement 5.

The upper opening 18 of the sealing tube 13 is hermetically sealed by the crysal 3 installed under pressure and seated with a radial friction lock against the inner wall 14 of the tube.

During assembly of the components, the crystal 3 is inserted into the tube 13 before the tube 13 is disposed within the casing center. 1. Since the sealing tube 13, not yet framed on the outside by its rising case center 2, is able to widen slightly during the installation of the crystal 3, there occurs no material shifting or even damage to the components (such as spalling of the inner wall 14 of the tube) which is detrimental from an optical or sealing standpoint.

The opposite, bottom opening 19 of the tube 13 is hermetically sealed by the bottom cover 4. The cover 4 has an annular circumferential wall 20 which is inserted into the tube 13 following the introduction of the movement with the face 17 mounted on it. The face is arranged with a slightly radial clearance within the tube 13 and abuts a lower shoulder 21 of the rim of the tube 13. The wall 20 is held by friction against the inner wall 14. The axial height of the wall 20 is such that its upper end 22 abuts a radially projecting collar 23 of the movement. Thus, the movement 5 and its face 17 are axially secured within the tube between the wall 20 and the rim 21.

For its introduction without damage into the lower tube opening 19, wall 20 is tapered-down in an upward direction and is shaped as a locator pin 24. Underlying the lower end 25 of the sealing tube 13 is a bottom flange 26 of the cover 4.

Following the insertion of the crystal 3 in the sealing tube 13 and the insertion of the movement 5 and cover 4 into the tube, the tube 13 is installed by press-fit into the case center 2 which acts as an external clamping ring to reinforce the tube in a radial direction. For example, the case center 2 opposes the radial outward forces imposed upon the tube 13 by the cover 4 and the crystal 3. The flat case 7 is preferably formed of metal, such as steel. The case 7 includes a location bore 27 which is coaxial with the smaller bore 10. The location bore 27 is terminated by a shoulder 29 of the case 7 which forms a part of an upper surface 28 of the case, which surface 28 is coplanar with the shoulder 21 of the tube. Upon the insertion of the bottom cover 4 into the sealing tube 13, the shoulder 29 forms an abutment seat for a projecting socket part 41 of the tube 13. Alternatively, the location bore 27 could be tapered-down in the upward direction, with the socket part being correspondingly tapered. The important consideration is for a portion of the tube 13 to underlie a portion of the case so that the latter forms a limit or stop for the upward insertion of the tube into the case.

The case center 2 extends axially to the height of the crystal 3 inserted in the sealing tube 13, in order to reinforce the tube against forces created by the crystal 3. This is achieved by mounting the bezel 6 on the surface 28 by machining or by molding it integrally with the case 7.

It is more convenient to provide the case center 2 in two parts and to impress, following the installation of the sealing tube 13 from below into the case 7, the bezel 6 downwardly onto the upper end of the sealing tube protruding upwards from the case center 2. For this purpose, at the lower edge 30 of the bezel the center opening of the bezel widens to form a bevel or locator recess 31, extending a certain axial insertion distance. This beveled transition insures the insertion of the bezel with a relatively low shear stress as the cylindrical surfaces move axially against each other.

Axially offset with respect to the recess 31 and located approximately in the center area of the rim projection 15, a circumferential retaining groove 32 is milled in the bezel 6. Into that groove 32 the hard plastic material of the sealing tube 13 is pressured slightly upon the installation of the tube, thereby providing an axial securing of the case center 2 and the other parts of the wristwatch 1 encompassed in the sealing tube 3.

With a flat case center 2, it is sufficient if the lower edge 30 of the bezel is resting flatly on the surface 28 of the case. In the case of axially higher configurations there is a potential risk of a tilting or shear stress on the part of the tube 13 protruding from the case 7 as the result of a lateral stress on the bezel 6. In such a case it is appropriate to mill a flat depression 33 into the surface 28 of the case 7, into which depression the lower edge 30 of the bezel is inserted, so that it is held rigidly in the radial direction within the case 7.

The wall 20 of the cover 4 has a U-shaped slot 34 extending from its top 22, which slot surrounds the setting shaft 9 in a fork-like manner between the movement 5 and the sealing tube 13. Thus, the bottom cover 4 may be pulled off and reinserted (even in the case of an already functionally assembled wristwatch 1) to replace the battery for example. The mounting of the setting shaft 9, following the clamping installation of the sealing tube 13 by means of the case 7, is effected through the case bore 10 and a radial bore 35 in the wall of the sealing tube 13. As a seal for the setting shaft, a groove 37 is milled in the outer wall 36 of the socket part 41 into which (prior to the clamping of the tube 13 into the case 7) an O-ring 38 is inserted with a slight radial compression. The O-ring is held in this position by the later-assembled case 7. Compared to the hard plastic material of the sealing tube 13, the O-ring 38 is a soft elastic (i.e., with a Shore hardness of the order of 50 to 60, compared with 70 to 80 for the material of the sealing tube 13). There is then no need for further measures or additional structural parts, regardless of how many parts the case center 2 consists of, to seal the setting shaft, as mentioned above.

For an enhanced aethetics, the hollow cylindrical (or possibly truncated cone-shaped) surface of the rim 16 visible through the crystal 3 may be metallized or laminated with an inserted metal ring 39 (FIG. 2). Otherwise, the case center 2 is pleasing in appearance in view of the flat case 7 (FIG. 2), the overall appearance whereof may be effected appreciably by the provision of a replaceable clamping bezel 6. Thus, by the choice of a bezel 6 coordinated with a wristband 40, a great variety of models of small, flat watches may be produced, while otherwise using identical functional parts.

The order of assembly of the parts is as follows. The crystal 3 is installed into the tube 13 from above. The movement 5 and its face 17 are installed into the tube 13 from below. The cover 4 is inserted into the tube 13 from below. The O-ring 38 is inserted into the tube 13. The tube 13 is inserted from below into the case 7. The bezel 6 is installed around the tube 13 from above. The shaft 9 is installed at any time following the insertion of the tube into the case 7.

Although the present invention has been described in connection with a preferred embodiment thereof, it will be appreciated by those skilled in the art that additions, modifications, substitutions, and deletions may be made without departing from the spirit and scope of the invention as defined in the appended claims.

What is claimed is:

1. A wristwatch comprising:

a clamping ring having an opening extending axially therethrough and a first passage extending therethrough in a radial direction with reference to the axis of said opening, said opening including a limiting surface disposed axially inwardly from an upper end of said clamping ring, a hollow cylindrical seal in the form of a hard plastic tube disposed generally coaxially in said opening and including:

a radially inward projection on an inner wall thereof to form, together with an axially extending portion of said tube, a cylindrical seat at an upper end of said tube, a radially outward projection forming a radially outwardly facing recess, said projection underlying said limiting surface to limit the extent of upward travel of said tube in said clamping ring, and a second passage aligned with said recess and with said first passage, a crystal mounted in said cylindrical seat, a movement and face mounted within said tube, a bottom cover mounted in a bottom end of said tube and confining said movement and face between itself and the underside of a shoulder of said tube, a setting shaft extending through said first and second passages and connected to said movement, the diameter of said setting shaft being substantially the same as that of said first passage, and an O-ring disposed in said recess so as to be confined between said tube and said clamping ring in surrounding relation to said setting shaft, said O-ring being formed of a material of greater elasticity than said tube and arranged in sealing relationship with said shaft.

2. A wristwatch according to claim 1, wherein said clamping ring includes a flat case and a bezel mounted atop said flat case and arranged to radially confine the portion of said tube disposed above said radially outward projection of said tube.

3. A wristwatch according to claim 2, wherein said bezel includes a bore having an expanded lower end to facilitate reception of said tube.

4. A wristwatch according to claim 2, wherein said flat case has a flat upper surface with a depression therein, said bezel being disposed in said depression.

5. A wristwatch according to claim 1, wherein said bottom has an upwardly extending wall which engages a portion of said tube opposite said radially outward projection, said movement engaging an upper edge of said wall.

6. A wristwatch according to claim 5, wherein said wall includes a slot through which said setting shaft extends.

7. A wristwatch according to claim 2, wherein said bezel includes a radially inwardly facing groove, a portion of said tube projecting into said groove to enhance the securement thereof.

8. A wristwatch according to claim 1, wherein said seat of said tube is covered by a ring which is visible through said crystal.

* * * * *